United States Patent [19]

Day et al.

[11] 4,086,464

[45] Apr. 25, 1978

[54] RESISTANCE HEATING DEVICE WITH IMPROVED WORKPIECE FEEDING MECHANISM

[75] Inventors: Paul L. Day, Parma; George M. Mucha, Parma Heights, both of Ohio

[73] Assignee: Park-Ohio Industries, Inc., Cleveland, Ohio

[21] Appl. No.: 706,852

[22] Filed: Jul. 20, 1976

[51] Int. Cl.[2] ..... C21D 9/62

[52] U.S. Cl. ..... 219/156; 219/56; 219/161; 221/299

[58] Field of Search ..... 148/153, 155; 219/50, 219/56, 57, 58, 156, 158, 161; 221/299

[56] References Cited

U.S. PATENT DOCUMENTS

| | | | |
|---|---|---|---|
| 1,509,097 | 9/1924 | Bisset et al. | 219/156 |
| 3,040,167 | 6/1962 | Greeno et al. | 219/156 |
| 3,705,973 | 12/1972 | Balzer et al. | 219/156 |
| 3,737,619 | 6/1973 | Arnosky et al. | 219/156 |
| 3,743,778 | 7/1973 | Day | 219/156 |

*Primary Examiner*—C. L. Albritton
*Assistant Examiner*—N.D. Herkamp
*Attorney, Agent, or Firm*—Meyer, Tilberry & Body

[57] ABSTRACT

In a device for resistance heating of an elongated, generally cylindrical metal workpiece preparatory to quench hardening wherein the workpiece has a central, elongated axis and axially spaced first and second ends. The heating device includes first and second axially spaced electrode means for directing electrical current through the workpiece and between the spaced ends as the workpiece is supported in a selected, generally horizontal heating position. The improved feeding arrangement includes a transfer element with first and second separate nest means for supporting a workpiece with its axis generally parallel to the heating position. The second nest means is spaced horizontally from the loading position. This transfer element is reciprocally mounted for movement between a first location with a workpiece in the first nest means at the heating position and a second location with the first nest means being spaced from the heating position. Means are provided for shifting the workpiece from the loading position on the second nest means as the transfer element moves toward its first location and means for transferring a workpiece from the second nest means to the first nest means upon movement of the transfer element from the first location toward the second location to provide easy movement of the workpiece from the loading position, to the second nest means, to the first nest means and, then, to the resistance heating position.

14 Claims, 6 Drawing Figures

RESISTANCE HEATING DEVICE WITH IMPROVED WORKPIECE FEEDING MECHANISM

The present invention relates to the art of resistance heating and more particularly to an improved workpiece feeding mechanism for an induction heating device.

The invention is particularly applicable for resistance heating an elongated, cylindrical workpiece, such as a cyclindrical chain saw file preparatory to quench hardening the outer surface thereof, and it will be described with particular reference thereto; however, it is appreciated that the invention has much broader applications and may be used for resistance heating of various elongated, cylindrical workpieces. The term "elongated" as used herein has the normal meaning and includes cylindrical workpieces with lengths at least about six times the workpiece diameter.

INCORPORATION BY REFERENCE

U.S. Pat. Nos. 3,705,973; 3,737,619; and 3,743,778 are incorporated by reference herein. These prior patents illustrate resistance heating devices of the general type contemplated by the present invention.

BACKGROUND OF INVENTION

As shown in the three prior United States Letters Patents identified above, it has become somewhat common practice to heat elongated, cylindrical workpieces by resistance techniques preparatory to quench hardening of these devices. Such heating operations involve the use of spaced electrodes which clamp onto the outer surface of the workpiece at axially spaced positions so that the center portion of the workpiece can be heated by passing a current between the electrodes and through the central portion. Generally, resistance heating devices are manually loaded and unloaded. This requires a substantial amount of manpower and constant attention to the device. Thus, there has been a substantial demand for automatically feeding elongated workpieces to the heating position of a resistance heating device. The difficulty with providing a feeding arrangement for the cylindrical workpieces is that the workpieces must be loaded and unloaded from the open side of the axially spaced electrodes. Thus, the loading and unloading must be done in the same general direction and using the same work area. This presents interference problems, since the feeding and discharging operation must occupy and function in the same space. Another difficulty is inherent in feeding workpieces to a resistance heating device. The workpieces must be unobstructed at their axial ends. Thus, the support must be spaced inwardly from the axial ends and the workpieces must be axially aligned to provide proper heating of the center portion during the heating operation.

THE INVENTION

The present invention relates to a feeding mechanism for a resistance heating device, which mechanism overcomes disadvantages inherently present in attempting to feed cylindrical workpieces to and from a resistance heating apparatus or device.

In accordance with the present invention, there is provided an improvement in the resistance heating device for heating elongated, generally cylindrical metal workpieces preparatory to quench hardening. These workpieces have a central, elongated axis and axially spaced first and second ends. This type of resistance heating device includes first and second axially spaced electrode means for directing electrical current through the workpiece and between the spaced ends as the workpiece is supported in a selected, generally horizontal heating position with the central axis extending in a selected direction. This type of device also includes means for delivering a succession of workpieces to the selected heating position. The present invention relates to an improvement wherein the workpiece delivering means includes conveying means for conveying a succession of the workpieces to a loading position spaced from the heating position and with the central axis of the workpiece in the loading position being generally parallel to the selected direction of the workpiece being heated. A transfer element is provided with first and second, separate workpiece receiving nest means for supporting a workpiece with its axis generally parallel to the selected direction of the heating position and with the second nest means being spaced horizontally from the loading position. There are also means for moving the transfer element between a first location with the workpiece in the first nest means being in the heating position and a second location with the first nest means being spaced from the heating position. The invention also includes means for shifting one of the workpieces from the loading position onto the second nest means as the transfer element moves toward the first location and means for transferring a workpiece from the second nest means to the first nest means upon movement of the transfer element from the first location toward the second location.

By providing the feeding arrangement as described above, cylindrical workpieces can be fed to a remote loading position. Thereafter, a reciprocal transfer element first picks up a workpiece on the second nest means and then transfers the workpiece to the first nest means which is movable to the heating position. By providing this two step transfer operation, the reciprocal movement of the transfer element toward and away from the heating position can maintain the workpieces in proper axial alignment without requiring pressure or friction from successive workpieces. Also, by providing this type of feeding arrangement, the downward movement of the transfer element leaves the space directly below the two spaced clamping electrodes of the resistance heating device open for a discharge conveying arrangement. This discharge conveying arrangement, in accordance with another aspect of the present invention, includes an exit conveyor means for conveying the heated workpiece from the heating position to a remote position which may be the quenching position. This exit conveying means includes a first means defining a first inclined wall segment and a second means defining a second inclined wall segment. The second inclined wall segment forms a continuation of the first wall segment to define a workpiece path inclined downwardly from the heating position. There is also provided means for moving the second means with respect to the heating position between a first operative position directly below the heating position and a second inoperative position spaced outwardly from the heating position. By providing an inoperative position for the uppermost inclined wall segment or segments, these segments may be moved from between the transfer element and the heating device. Thus, the transfer element may be reciprocated without interference from the conveying arrangement used to direct a heated workpiece from the device to a subsequent processing position, such as a quench tank.

In accordance with another aspect of the invention, the segments which are movable to allow clearance for the transfer element are in the form of two spaced first and second rails which are movable inwardly to accept a dropped heated workpiece and are then movable outwardly in an axial direction from the heating position to allow clearance for subsequent loading of the resistance heating device by the reciprocally mounted transfer element.

The primary object of the present invention is the provision of a feeding mechanism for a resistance heating device used to heat elongated, generally cylindrical workpieces, which mechanism provides easy loading of the device, can be used with various resistance heating devices, and creates a space for unloading the device on the feeding side of the heating device.

Another object of the present invention is the provision of a mechanism as described above, which mechanism feeds each cylindrical workpiece into the heating device separately and without interference from subsequent or prior workpieces.

Still a further object of the present invention is the provision of a mechanism as described above, which mechanism requires only reciprocation of a single transfer element to load the workpiece onto the element, shift a workpiece to a feeding position on the element and then deposit the workpiece in the desired heating position in the heating device.

Another object of the present invention is the provision of a mechanism as described above, which mechanism can be used with an exit conveyor that alternately shifts to a discharge, operative position and then to a withdrawing, inoperative, clearance position.

These and other objects and advantages will become apparent from the following description taken together with the accompanying drawings which will be described below.

PREFERRED EMBODIMENT

Figure 2:
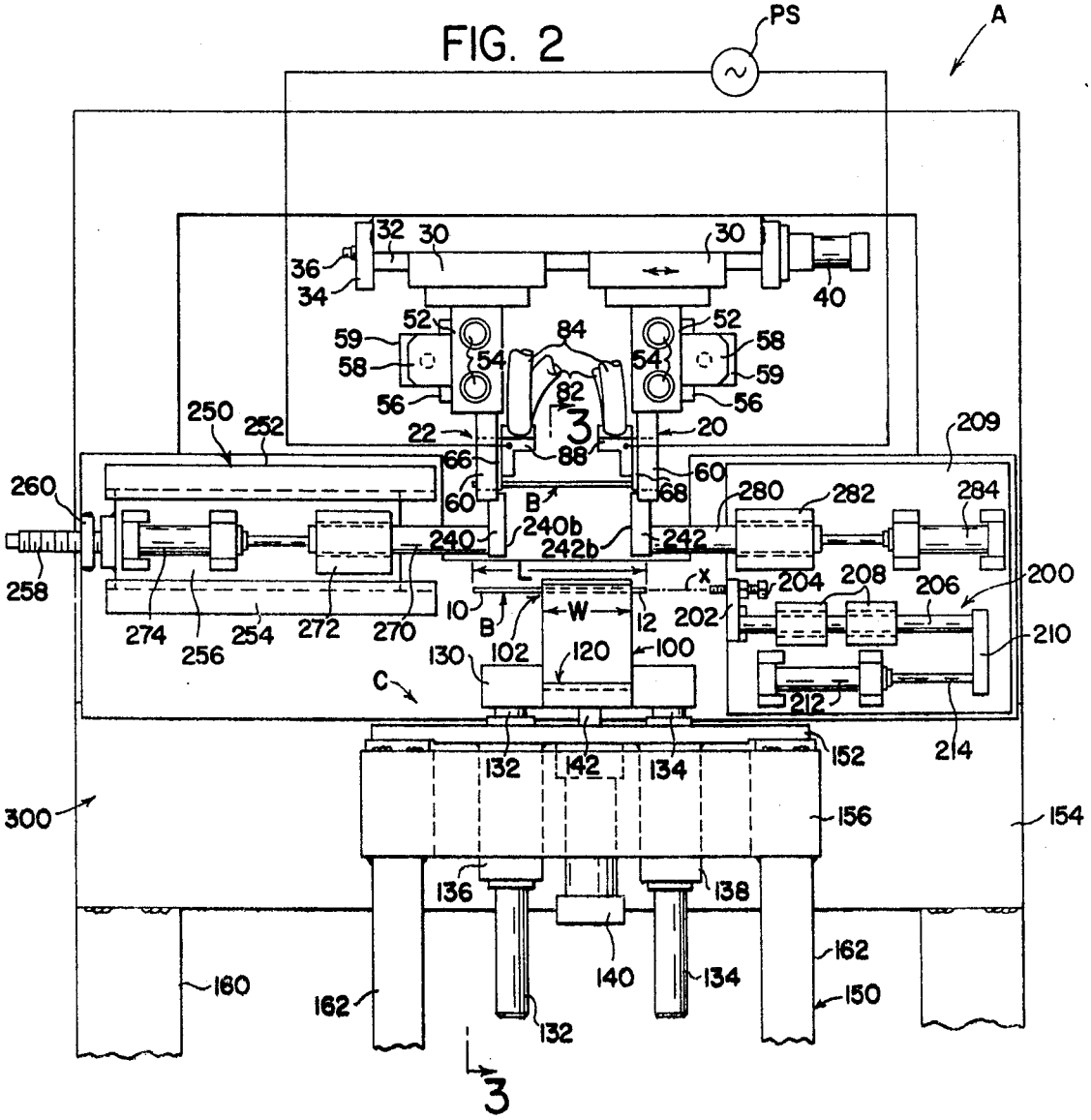
FIG. 2 is a front elevational view taken generally along line 2—2 of FIG. 1.

Referring now to the drawings wherein the showings are for the purpose of illustrating a preferred embodiment of the invention only, and not for the purpose of limiting same, a resistance heating device A is provided for resistance heating elongated, generally cylindrical workpieces B each of which has a central, elongated axis *x* and axially spaced ends 10, 12, as best shown in FIG. 2. In practice, these workpieces are steel cylindrical files which are to be heated between the spaced ends to a quench hardening temperature of about 1700° F before being directed to a quenching tank for subsequent quench hardening. In accordance with the invention, there is provided a workpiece feeding mechanism C for feeding workpieces B into resistance heating device A and an exit conveyor mechanism for removing the heated workpieces and transporting them to a quenching tank.

Figure 1:
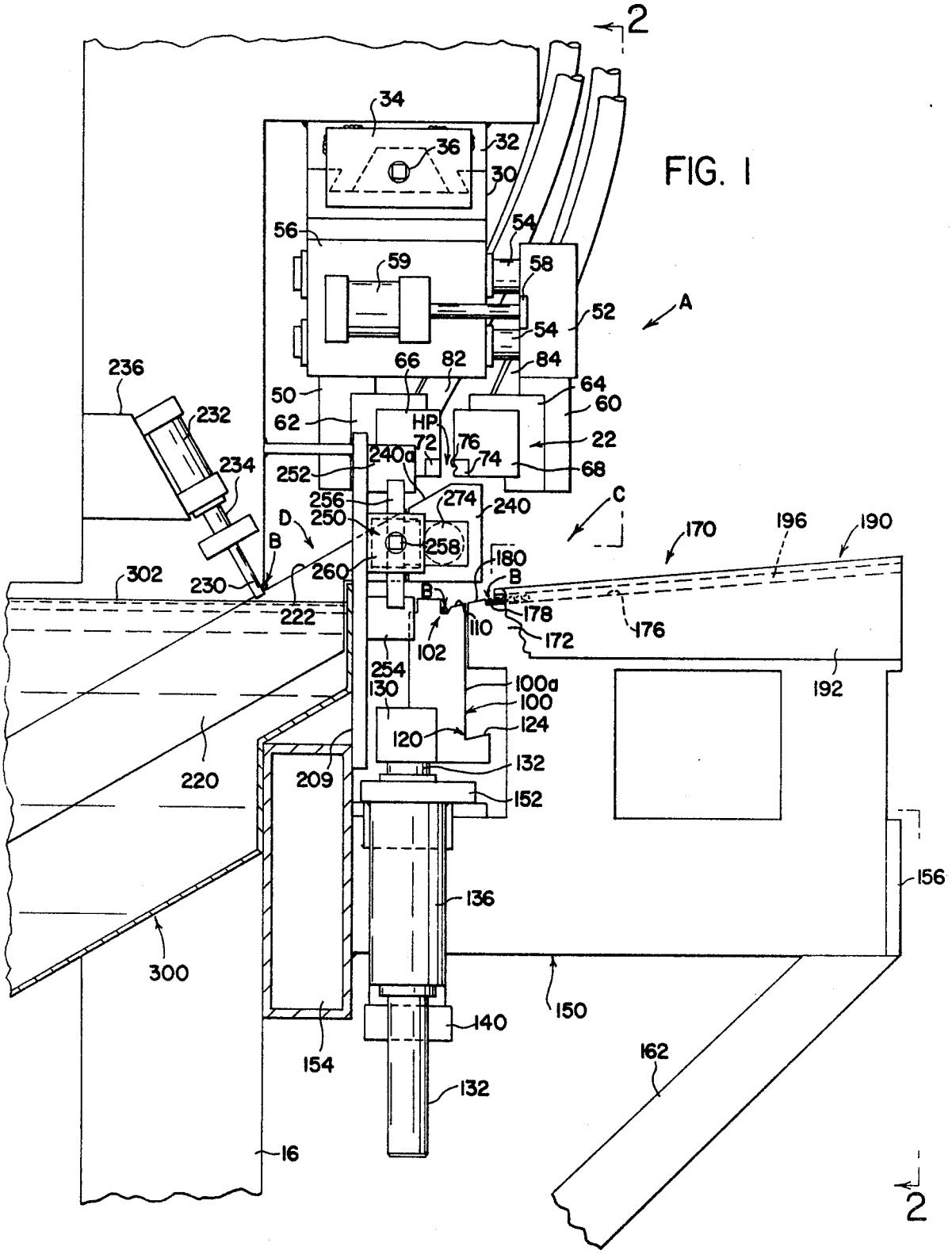
FIG. 1 is a schematic side elevation view illustrating the preferred embodiment of the present invention.

In accordance with the illustrated embodiment, the resistance heating device A includes spaced clamping electrode heads 20, 22, best shown in FIG. 2. Both of these heads are substantially the same; therefore, clamping electrode head 22 will be described in detail and this description will apply equally to the axially spaced clamping electrode head 20. These clamping heads each include a support or carrier 30 which is movable in a direction axially of workpiece B on stationary way 32. A stop 34 carries an adjustment bolt 36 for changing the position of the carrier 30 associated with electrode head 22. The other head is movable in an axial direction by a cylinder 40. In practice, the carrier 30 associated with electrode head 22 remains stationary at an adjusted position determined by bolt 36. Cylinder 40 applies a force to the right on carrier 30 to exert a tension on workpiece B being heated at the heating position HP. Thus, tension is applied to the workpiece B as it is being resistance heated between its axially spaced ends 10, 12 to prevent sag and bowing. Each of the electrode heads includes a stationary arm 50 and a laterally movable arm 52 carried by two spaced quide pins 54 reciprocally mounted within a support journal 56. Bracket 58 is controlled by a clamping cylinder 59 so that during the heating operation arm 52 is pulled to the left, as shown in FIG. 1, to clamp a workpiece between the movable arm 52 and the stationary arm 50. A bracket 60 extends downwardly from movable arm 52 and mounting blocks 62, 64 support spaced clamping electrodes 66, 68 which are insulated from blocks 62, 64 by an appropriate insulation indicated as insulation 70. Inserts 72, 74 are used to engage the outer surface of workpiece B when it is being heated in the heating position HP. Insert 72 has a generally flat outer surface while insert 74 has a centering V-shaped groove 76 extending axially of workpiece B. This groove engages one surface of workpiece B to hold the workpiece in heating position HP during the resistance heating operation. As best shown in FIGS. 3–6, the mounting blocks 62, 64 are held onto arm 50 and plate 60 by an appropriate means schematically illustrated as bolts 78 on arm 50. Similar bolts are provided on plate 60, but are eliminated for clarity. A lower clamp bracket 80 is used to hold the insert 72 onto electrode 66. These clamp brackets 80 are bolted to electrodes 66, 68 and apply a holding force for the inserts 72, 74. Only one of the clamps 80 is shown for the purposes of simplicity. To conduct electricity to electrodes 66, 68, there is provided a pair of flexible leads 82, 84 which are connected as a pair to one end of a power supply PS. The other pair of leads 82, 84 are connected to the other side of the power supply so that an alternating current is directed by these leads through the inserts 72, 74 and through the length of workpiece B between the spaced clamping electrode heads 20, 22. In essence, the device A produces the resistance heating operation which heats the cylindrical surface between ends 10, 12 of a workpiece B positioned within the horizontally extending heating position HP, which position is determined by the V-shaped grooves 76 of electrodes 68.

Figure 3:
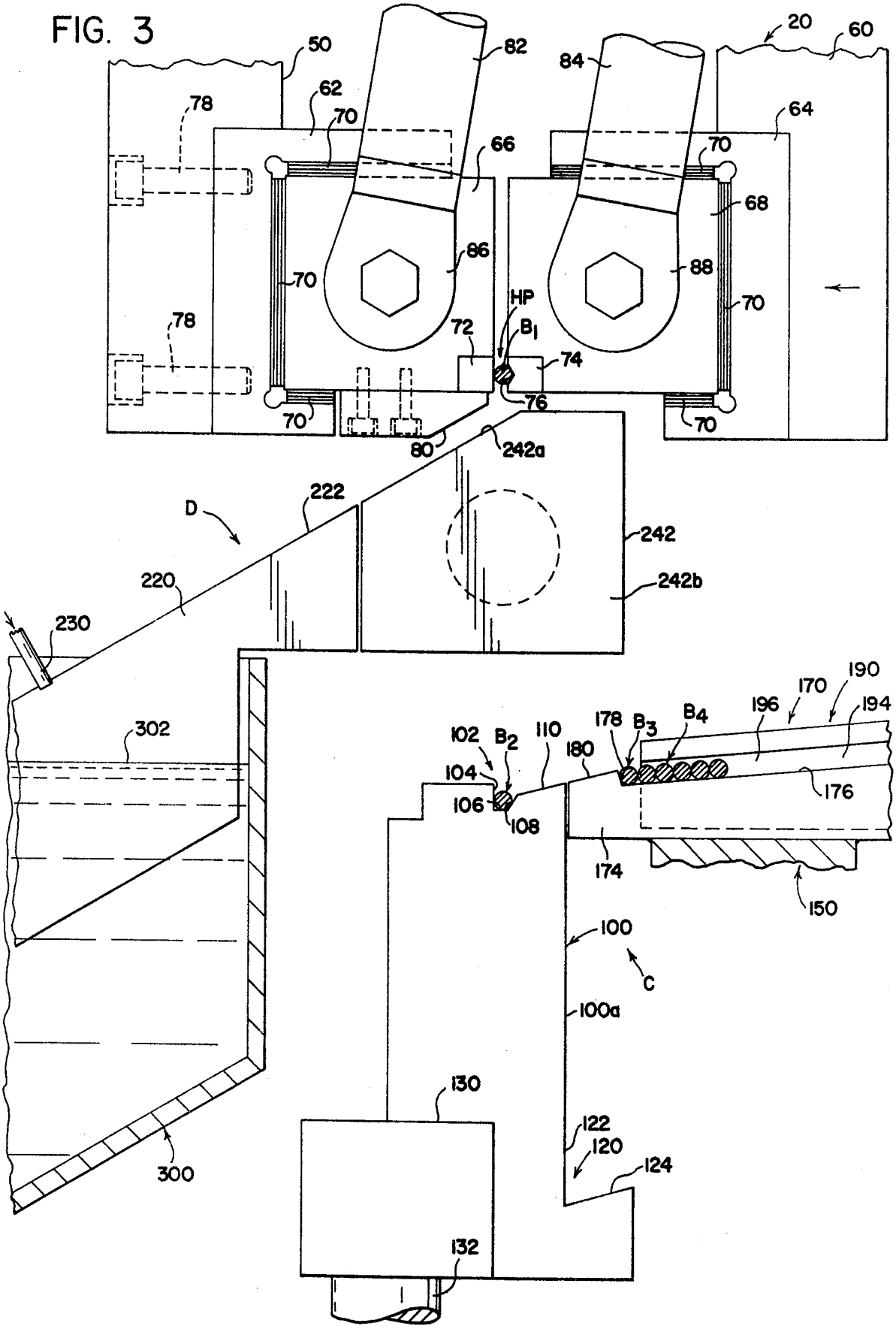
FIG. 3 is an enlarged partial view taken generally along line 3—3 of FIG. 2; and, FIGS. 4–6 are views similar to that shown in FIG. 3 illustrating different operating positions of the preferred embodiment of the present invention.

Referring now to the feeding mechanism C, as best shown in FIGS. 1–3, this mechanism includes an arrangement for transferring a workpiece B from a remote loading position to heating position HP. In accordance with the invention, a transfer element 100 with a generally flat surface **100*a* is movable between a first location with the workpiece supported at the heating position and a second location spaced therefrom. In the preferred embodiment of the invention, transfer element 100 is reciprocated in a vertical direction below the heating position and includes a first nest means 102 for supporting a workpiece B in a direction parallel to the desired heating position of a workpiece and intermediate the ends 10, 12 of the workpiece. In the preferred embodiment, nest means 102 is in the form of an axially extending groove defined by a generally flat, vertical wall 104, a flat lower wall 106 and an inclined wall 108. The inclined wall causes centering of the workpiece B in nest means 102 by rotation of a workpiece into the groove and in a position parallel to the final heating position of the workpiece. An inclined wall 10 is directed from the nest means outwardly, as best shown in FIG. 3. This inclined wall forms a first segment of a combined inclined ramp or wall means for directing a workpiece B into nest 102 in a manner to be described later. Transfer element 100 includes a second nest means 120 which functions as an escapement structure and is vertically spaced below nest means 102 and laterally offset with respect to the first nest means and the heating position HP. Nest means 102 is vertically aligned with the heating position; however, other arrangements could be provided for operation of a movable transfer having the characteristics to be described later. The second nest means is used to shift a workpiece to the left into a position determined by a longitudinal groove or support structure. The workpiece is supported in a direction generally parallel to the position determined by nest means 102 and the heating position HP. As illustrated, the second nest means is defined by an abutment wall 122 which intersects with an inclined wall 124. The workpiece B can roll down the inclined wall into engagement with the abutment wall to fix the workpiece on transfer element 100 for a purpose to be described later. Transfer element 100 is movable by a lower support base 130 downward from which extends guide pins 132, 134 which are reciprocally mounted in generally fixed journals 136, 138, respectively. A cylinder 140 actuates a rod 142, shown in FIG. 2, to move support base 130 vertically. This carries transfer element 100 so that cylinder 140 can shift this element between first and second vertically spaced locations. An appropriate stop means can be provided on either the support base 130 or the transfer element 100 to define the uppermost position of transfer element 100**.

A fixed support frame 150 supports the journals 136, 138 in a fixed relationship with respect to resistance heating device A. This frame can take a variety of forms; however, in accordance with the illustrated embodiment, an upper cross plate 152 and a rear connecting plate 156 extend across frame 150. The frame is, in turn, secured onto fixed legs 160 and struts 162 support the right portion of frame 150 in a cantilever fashion. Onto frame 150 there is provided a magazine feeding arrangement or feeder 170 which accepts manually deposited workpieces B and progresses them toward transfer element 100 for subsequent conveyance by the feeding mechanism C to the heating position HP. Magazine feeder 170 can take a variety of forms to shift workpieces into the loading position for pick-up by the reciprocating transfer element. In practice, this magazine feeder includes spaced side support elements 172, 174 which form a part of frame 150 and are secured in an axially fixed position. Since these two spaced side support elements are substantially the same, only element 174 will be described in detail and this description will apply equally to element 172. These elements include an upper inclined edge 176 which allows gravity feeding the workpiece B toward a lower stop wall or abutment 178. This abutment defines, with the upper edges 176, the loading position for transfer of the workpiece B onto transfer element 100. The element 172, 174 terminate in inclined upwardly facing edges 180 which generally match inclined wall 110 and form a continuation or a second segment thereof, which when aligned causes a continuous path for a workpiece B to rotate from the edges 180 to the inclined wall 110 and then into first nest means 102. To align the workpieces within magazine feeder 170, there is provided a cover 190 with axially spaced side or end walls 192, 194, which define with upper edges 176 a transfer slot 196 through which workpieces B are fed by gravity. Walls 192, 194 are axially spaced with respect to workpieces B and retain these workpieces in a defined axial position on the spaced edges 176 so that they are transferred into the loading position at walls 178 in generally the same position. Other arrangements could be provided for feeding manually loaded workpieces to the position adjacent element 100, as illustrated in FIG. 3.

After a workpiece is positioned on nest means 102 of transfer element 100, it is aligned in an axial direction with respect to this element. Magazine feeder 170 places a workpiece in a position which is to the right of the desired position when viewed in FIG. 2. Thereafter, an axial positioning mechanism 200 fixes the axial position of workpiece B with respect to element 100 prior to the element being placed into the heating position HP. This type of mechanism could take a variety of structural forms; however, in accordance with the illustrated embodiment, a support plate 202 carries an adjustable bolt 204 which is locked into a desired axial position generally aligned with the elongated axis $x$ of a workpiece B supported in nest means 102. Reciprocal movement of plate 202 is provided by a rod 206 journalled in spaced journals 208 secured onto a generally fixed structural plate 209. This plate, as shown in FIG. 1, is secured onto the front beam 154 of the fixed support structure. An operating arm 210 connects rod 206 with the rod 214 of a cylinder 212. Thus, as rod 214 is moved to the left, bolt 204 engages axial end 12 of the workpiece B in nest means 102. This shifts the workpiece with respect to transfer element 100 to the desired axial position for subsequent heating at the heating position HP. By providing an original position determined by feeder 170 which is offset to the right from the desired position, mechanism 200 provides an accurate alignment for workpieces B prior to being raised into the heating position. The center of gravity of the workpiece B is maintained on transfer element 100 so that the workpiece is firmly held by gravity in nest means 102 while being shifted upwardly into the heating position.

Referring now to the exit conveyor D, best shown in FIGS. 1 and 3, this conveyor includes an arrangement for conveying a workpiece B from the heating position after it has been heated. This conveying arrangement is directed toward the same side, i.e., lower side, of spaced electrode heads 20, 22 so that feeding and unloading of the workpieces is done from the same side of the heating device. In accordance with the preferred embodiment of the invention, a ramp 220 which in practice is two spaced ramp plates that include an upper fixed edge or surface 222 which is inclined away from the heating position and generally aligned therewith. If two spaced bars or plates are used to define the inclined edge or surface 222, the spacing between the plates must be substantially less than the length L of workpieces B. A selectively operable stop 230 is shifted between the positions shown in FIG. 1 and FIG. 5 by an appropriate arrangement, such as cylinder 232 which operates a rod 234 connected to the stop 230. A fixed bracket 236 supports this stop mechanism. Stop 230 is generally an elongated plate extending parallel to the axis of a workpiece B rolling down surface 222 and between the spaced edges defining this surface to realign a workpiece before quenching. If the ramp is a continuous plate extending across the axial length of a workpiece, a clearance opening would be provided for the elongated plate or stop 230. Of course, two or more spaced elements could be provided to form the stop 230. Ramp extension pieces 240, 242 have upper inclined edges 240*a*, 242*a* and inwardly facing, generally flat surfaces 240*b*, 242*b*. These ramp extension pieces are shiftable axially to provide a clearance for a transfer element 100. Thus, an arrangement is provided for shifting ramp pieces 240, 242 away from the heating position a distance at least as great as the length L of a workpiece B. In practice, the retracted position of ramp pieces 240, 242 is substantially greater than the length of the workpieces being heated.

A variety of structures could be used for shifting the ramp pieces 240, 242 between their operative positions forming an extension of edges or surface 242 and their inoperative positions forming a clearance space therebetween for the movement of vertically movable transfer element 100 with a workpiece carried thereby. In the preferred embodiment, ramp extension piece 240 is movable by mechanism 250, best shown in FIG. 2. This mechanism includes two parallel guide blocks 252, 254 for receiving an axially adjustable shuttle 256, the axial position of which is determined by the adjustment of a bolt 258. This bolt extends through a threaded boss 260 to control the position of shuttle 256. A rod 270 is secured onto extension piece 240 and is journalled in a guide block 272. Cylinder 274 reciprocates rod 270 to shift ramp extension piece 240 to a position beyond end 10 of workpiece B and then into the position shown in FIG. 2 which produces an alignment of surface 240*a* with surface 222 to form an inclined ramp from the heating position HP past the stop 230. Ramp extension piece 242 is reciprocated by a rod 280 journalled in guide blocks 282 and operated by a cylinder 284. By retracting cylinder 284, extension piece 242 is shifted to the right to clear surface 242*b* from end 12 of workpiece B as element 100 shifts the workpiece vertically upward into the heating position between axially spaced electrode heads 20, 22. When a workpiece is stopped by member 230, it is then released by retracting this member. This causes the workpiece to enter a fixed quenching tank 300 having an upper level 302 of quenching liquid.

The above description of the preferred embodiment of the present invention clearly indicates the operating characteristics of the various features employed in the preferred embodiment of the invention. The operation of this device can be appreciated by reviewing the operating steps shown in FIGS. 3–6. A first workpiece $B_1$ is shown in the heating position HP and is being heated by passing a current between clamping electrode heads 20, 22 engaging opposite axial ends 10, 12 of workpiece $B_1$. Ramp extension pieces 240, 242 are shifted into a position aligning edges 240*a*, 242*a* with edges or surface 222. Thus, the ramp extensions are shifted inwardly by rods 270, 280 to be directly below workpiece $B_1$ which is being heated. At the same time, a workpiece $B_2$ has rolled down inclined segments 110, 180 into the first nest means 102, as shown in FIG. 3. A third workpiece $B_3$ is at the loading position defined by stop or abutment wall 178. Other successive workpieces generally labeled $B_4$ are aligned axially in succession behind the awaiting workpiece $B_3$.

Figure 4:
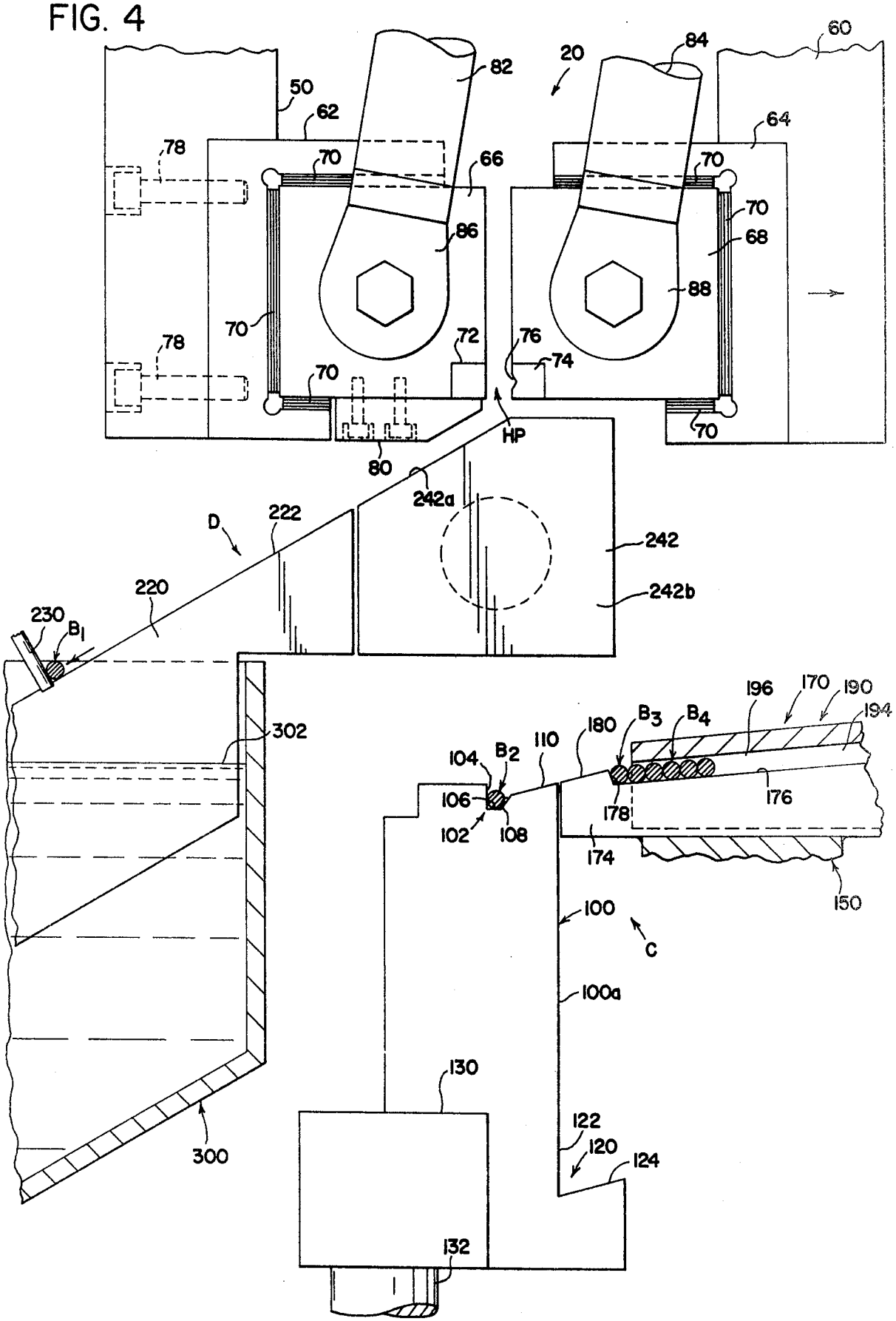
Figure 5:
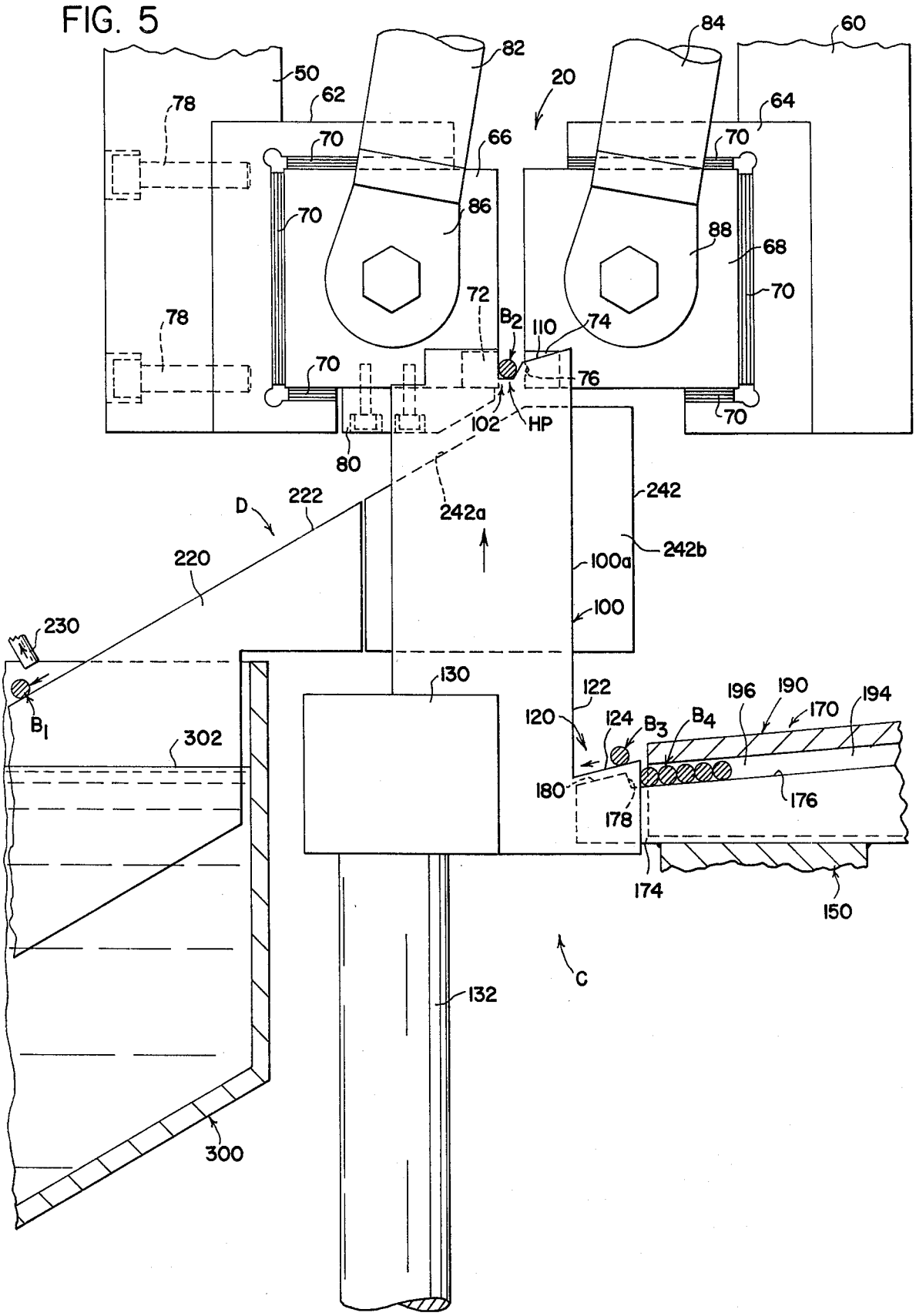
Figure 6:
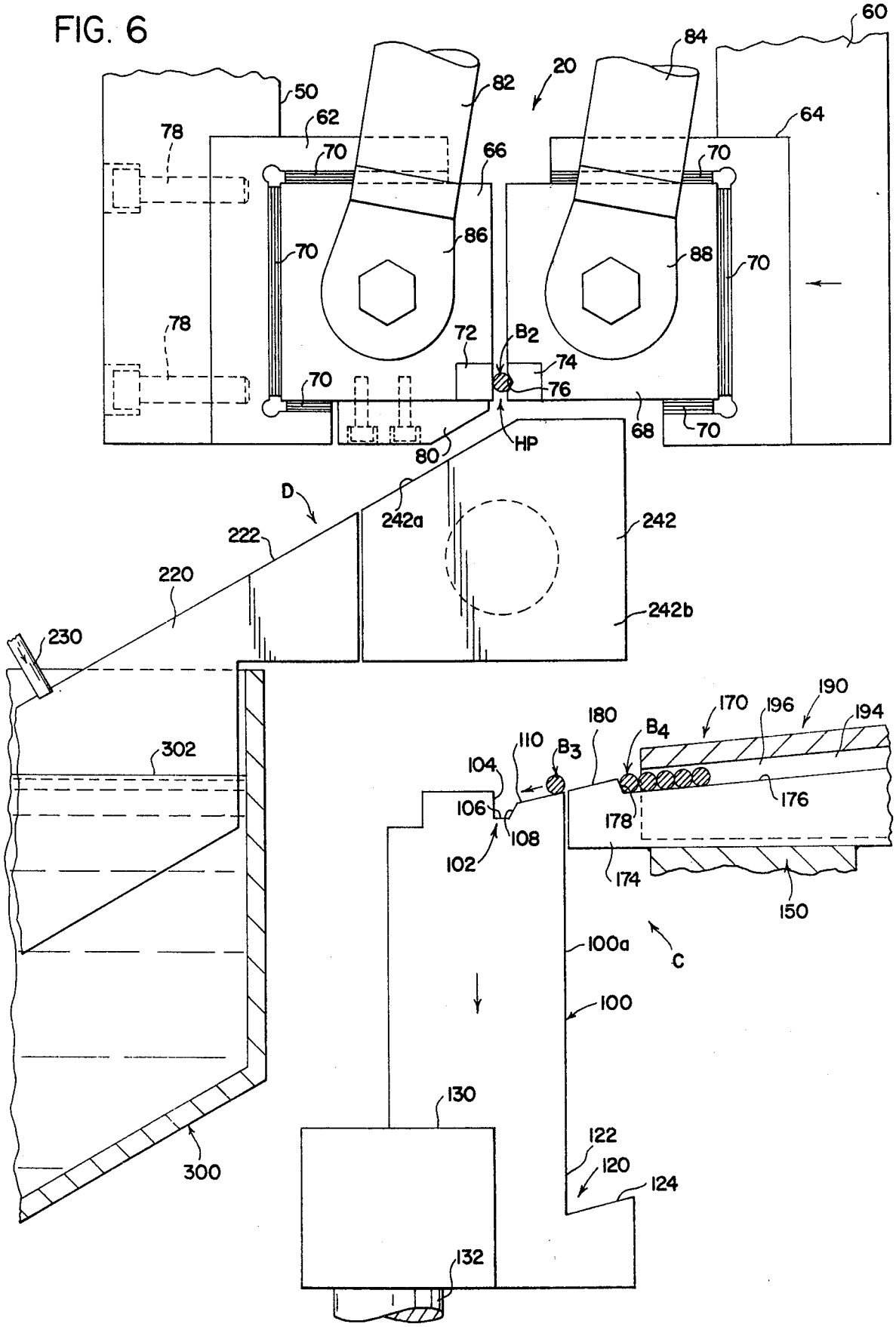

Referring now to FIG. 4, the heating operation has been completed. Arms 52 are shifted to the right on guide pins 54 which releases workpiece $B_1$ from its clamped position between inserts 72, 74. This heated workpiece then rolls down edges 240*a*, 242*a* onto edges or surface 222. Stop 230 then stops the workpiece as shown in FIG. 4. If the workpiece is properly heated as can be detected by a pyrometer, it is released from the stop means 230 and commences its movement along surface or edges 222 into the quenching liquid of tank 300. Thereafter, the workpiece can be removed by an appropriate mechanism. Stop means 230 aligns workpiece $B_1$ before it is directed into the quenching tank 300. This time delay may be desirable for some quenching operations. Thus, stop 230 can provide a delay in the quenching, if desired. Release of the workpiece $B_1$ is schematically illustrated in FIG. 5. In the meantime, ramp extension pieces 240, 242 have been moved outwardly into their inoperative positions spaced from the path to be traveled by workpiece $B_2$ from its lowered position shown in FIG. 4 into the upper position shown in FIG. 5. Upward movement of transfer element 100 into the upper position by cylinder 140 brings the next workpiece $B_2$ into the heating position HP. At the same time, inclined surface 124 passes between spaced side support elements 172, 174 and lifts the workpiece $B_3$ from the loading position determined by stop wall 178. During this motion, workpiece $B_3$ rotates downwardly on inclined wall 124 to a position adjacent abutment wall 122 which is aligned vertically with inclined surface 180. Workpiece $B_2$ is clamped between electrode heads 20, 22 so that transfer element 100 may be moved downwardly as shown in FIG. 6. This retains workpiece $B_2$ in the heating position and lifts the next workpiece $B_3$ from surface 124 of the second or escapement nest means 120 as element 100 is moved downwardly past inclined surface 180. Workpiece $B_3$ is deposited onto space inclined surface 180. When the transfer element is being moved downwardly, generally flat surface 100*a* of element 100 holds workpiece $B_3$ in a position awaiting concurrence of upper inclined surface 110. When this upper inclined surface registers with the fixed inclined surfaces 180 of spaced elements 172, 174, workpiece $B_3$ rotates from surface 180 onto surface 110. From there, the workpiece rotates along surface 110 into first nest means 102 where it is registered. Thereafter, axially aligning mechanism 200 is operated to shift the workpiece $B_3$ into the desired axial alignment. Ramp extension pieces 240, 242 remain in the outward inoperative positions so that workpiece $B_3$ can replace workpiece $B_2$ after workpiece $B_2$ has been discharged. Cylinder 40 applies a tension to the workpiece B during the heating position to prevent sagging of the workpiece.

Having thus described our invention, we now claim:

1. In a device for resistance heating of an elongated, generally cylindrical metal workpiece preparatory to quench hardening, said workpiece having a central, elongated axis and axially spaced first and second ends, said device including first and second axially spaced electrode means for directing electrical current through said workpiece and between said spaced ends as said workpiece is supported in a selected, generally horizontal heating position with said central axis extending in a selected direction, and means for delivering a succession of said workpieces to said selected heating position, the improvement comprising: said workpiece delivering means including conveying means for conveying a succession of said workpieces to a loading position spaced from said heating position and with the central axis of a workpiece in said loading position being generally parallel to said selected direction; a transfer element having first and second separate nest means for supporting a workpiece with its axis generally parallel to said selected direction, said second nest means being spaced horizontally from said loading position; means for moving said transfer element between a first location with a workpiece in said first nest means being in said heating position and a second location with said first nest means being spaced from said heating position; means for shifting one of said workpieces from said loading position onto said second nest means as said transfer element moves toward said first location; and, means for transferring a workpiece from said second nest means to said first nest means upon movement of said transfer element from said first location toward said second location.

2. The improvement as defined in claim 1 wherein said element moving means includes means for moving said element in a generally vertical direction between said first and second locations.

3. The improvement as defined in claim 2 wherein said first location is above said second location.

4. The improvement as defined in claim 1 wherein said first location is above said second location.

5. The improvement as defined in claim 1 wherein said shifting means includes at least two, axially spaced support members for supporting one of said workpieces in said loading position; inclined wall means on said element and extending from said second nest means upwardly toward said loading position; said wall means intersecting and lifting a workpiece from said loading means onto said inclined wall means as said element is moved from said first location toward said second location whereby said workpiece moves downwardly from said loading position to said second nest means.

6. The improvement as defined in claim 5 wherein said transferring means includes first and second complementary inclined wall segments, said segments being generally aligned and inclined from a position aligned with said second nest means to said first nest means when said transfer element is in a transfer position, said first segment being on said transfer element and said second segment being generally fixed; and, means for transferring a workpiece from said second nest means to said second segment when said transfer element is moved from said first location toward said second location whereby said workpiece will rotate along said first and second inclined wall segments into said first nest means.

7. The improvement as defined in claim 1 wherein said transferring means includes first and second complementary inclined wall segments, said segments being generally aligned and inclined from a position aligned with said second nest means to said first nest means when said transfer element is in a transfer position, said first segment being on said transfer element and said second segment being generally fixed; and means for transferring a workpiece from said second nest means to said second segment when said transfer element is moved from said first location toward said second location whereby said workpiece will rotate along said first and second inclined wall segments into said first nest means.

8. In an improvement as defined in claim 1 including an exit conveying means for conveying a heated workpiece from said heating position to a remote position, said exit conveying means including a first means defining a first inclined wall segment and a second means defining a second inclined wall segment, said second inclined wall segment forming a continuation of said first wall segment to define a workpiece path inclined downwardly from said heating position, and means for moving said second means with respect to said heating position between a first operative position between said transfer element and said heating position and a second inoperative position not between said transfer element and said heating position.

9. In a device for resistance heating of an elongated, generally cylindrical metal workpiece preparatory to quench hardening, said workpiece having a central, elongated axis and axially spaced first and second ends, said device including first and second axially spaced electrode means for directing electrical current through said workpiece and between said spaced ends as said workpiece is supported in a selected, generally horizontal heating position with said central axis extending in a selected direction, and means for delivering a succession of said workpieces to said selected heating position, the improvement comprising: said workpiece delivering means including, means for providing a succession of said workpieces at a loading position generally below said heating position, with the central axis of a workpiece in said loading position being generally parallel to said selected direction; a transfer means having a first and second vertically spaced, separate nest means for supporting a workpiece with its axis generally parallel to said selected direction; a first upwardly inclined, upwardly facing wall segment extending toward said first nest means; a second upwardly inclined, upwardly facing wall segment extending from said second nest means in a direction generally corresponding to said first wall segment; a generally fixed inclined element extending from said loading position toward said transfer element, said inclined element and said loading position being generally aligned with said second inclined wall segment; means for allowing said second inclined wall segment to move vertically with respect to said fixed element and loading position to remove a workpiece from said loading position by said second inclined wall when said transfer element is moved vertically upward and for depositing said workpiece onto said fixed element as said transfer element is moved vertically downward; means for transferring said workpiece for said fixed element to said first inclined wall segment when said transfer element is moved vertically downward; and, means for moving said transfer element between a first vertically raised location with a workpiece in said first nest means positioned in said heating position and a second vertically lowered location with said first inclined wall segment generally aligned with said generally fixed inclined element.

10. The improvement as defined in claim 9 including an exit conveying means for conveying a heated workpiece from said heating position to a remote position, said exit conveying means including a first means defining a first inclined wall segment and a second means defining a second inclined wall segment, said second inclined wall segment forming a continuation of said first wall segment to define a workpiece path inclined downwardly from said heating position and means for moving said second means with respect to said heating position between a first operative position directly below said heating position and a second inoperative position spaced outwardly from said heating position.

11. The improvement as defined in claim 10 wherein said second means includes first and second rails and said moving means includes means for moving said rails axially of said heating position.

12. The improvement as defined in claim 11 wherein said rail moving means moves said rails axially a distance sufficient to allow passage therebetween of said transfer element.

13. The improvement as defined in claim 10 wherein said second means includes means for moving said second means from a position between said heating position and said transfer element.

14. A transfer mechanism for conveying a cylindrical workpiece having a given length, a central elongated axis and axially spaced ends from a loading position to a spaced processing position, said positions being axially parallel, said transfer mechanism comprising: at least two spaced elements having upwardly facing matching inclined edges spaced from each other a selected distance substantially less than said length of said workpiece and inclined downwardly from adjacent said loading position and in a first direction; a transfer element having first and second workpiece nest means for supporting a workpiece in first and second positions, respectively with said first and second positions each having a direction generally parallel to said heating and loading positions; means for moving said transfer element between a raised location with a workpiece in said first nest means being at said heating position and a lowered second location; an inclined wall means for lifting a workpiece from said loading position and allowing it to rotate into said second nest means and vertically aligned with said matching edges whereby said workpiece is transferred from said second nest means to said matching edges when said transfer element is moved from said first location to said second location; and a second inclined wall means on said transfer element for directing said workpiece from said matching edges to said first nest means when said transfer element is in said second position.

* * * * *